US009297120B2

(12) United States Patent
Lessard et al.

(10) Patent No.: US 9,297,120 B2
(45) Date of Patent: Mar. 29, 2016

(54) PAPER-BASED MALLEABLE DOUGH FOR MOULDING AND SCULPTING APPLICATIONS

(71) Applicants: Mario Lessard, Napierville (CA); Christine Thibeault, Napierville (CA)

(72) Inventors: Mario Lessard, Napierville (CA); Christine Thibeault, Napierville (CA)

( * ) Notice: Subject to any disclaimer, the term of this patent is extended or adjusted under 35 U.S.C. 154(b) by 0 days.

(21) Appl. No.: 13/945,187

(22) Filed: Jul. 18, 2013

(65) Prior Publication Data

US 2015/0020986 A1 Jan. 22, 2015

(51) Int. Cl.

| | |
|---|---|
| ***D21J 3/00*** | (2006.01) |
| ***D21J 1/06*** | (2006.01) |
| ***D21J 1/08*** | (2006.01) |
| ***D21J 1/12*** | (2006.01) |
| ***D21J 1/20*** | (2006.01) |

(52) U.S. Cl.

CPC .... *D21J 3/00* (2013.01); *D21J 1/06* (2013.01); *D21J 1/08* (2013.01); *D21J 1/12* (2013.01); *D21J 1/20* (2013.01)

(58) Field of Classification Search

USPC ..... 162/158, 161, 162, 181.1, 189, 218, 162/225, 221–223; 106/15.05, 638, 697, 106/705, 708, 400–401, 493, 772–805, 106/163.01

See application file for complete search history.

(56) References Cited

U.S. PATENT DOCUMENTS

| | | | | |
|---|---|---|---|---|
| 3,390,003 | A * | 6/1968 | Cooper | 106/780 |
| 3,426,122 | A * | 2/1969 | Gaudelli et al. | 264/297.9 |
| 3,507,058 | A * | 4/1970 | Olenska | 36/34 A |
| 3,895,997 | A * | 7/1975 | Haywood | 162/100 |
| 5,653,797 | A * | 8/1997 | Patel | C04B 24/2652 106/778 |
| 5,849,152 | A * | 12/1998 | Arnold et al. | 162/116 |
| 6,436,185 | B1 * | 8/2002 | Ayambem | C04B 24/2641 106/793 |
| 7,556,685 | B2 * | 7/2009 | Nicholson et al. | 106/772 |
| 8,673,071 | B2 * | 3/2014 | Immordino, Jr. | C04B 40/0042 106/772 |
| 2004/0003561 | A1 * | 1/2004 | Ringness | 52/314 |
| 2005/0275138 | A1 * | 12/2005 | Rosen et al. | 264/299 |
| 2007/0051281 | A1 | 3/2007 | Nicholson et al. | |
| 2009/0260152 | A1 * | 10/2009 | Webster | 4/619 |
| 2010/0212549 | A1 * | 8/2010 | Holbek et al. | 106/661 |

OTHER PUBLICATIONS

Smook, Gary A., Handbook for Pulp and Paper Technologists, 2nd ed, Angus Wilde Publications, 1992, p. 220.*

"Sheetrock® Brand Lightweight Setting-Type Joint Compounds", United States Gypsum Company, 2013, [online], retrieved from the Internet, [retrieved Jul. 16, 2015], <URL: https://www.huttig.com/pdf/USG_Sheetrock_Easy_Sand.pdf>.*

(Continued)

*Primary Examiner* — Dennis Cordray

(74) *Attorney, Agent, or Firm* — Agence de Brevets Fournier; Claude Fournier

(57) ABSTRACT

Embodiments of a process for manufacturing a paper-based malleable dough for moulding and sculpting applications are described herein that include: soaking and mixing shredded paper in water, yielding a paper dough; and adding and mixing at least one setting-type joint compound with the paper dough. The at-least one setting type compound is added in a weight ratio of setting type compound to shredded paper of between about 11:8 to 17:8. The paper-based malleable dough allows creating objects that are ecological, durable, malleable and lightweight and that brings out the creative side of the user.

21 Claims, 7 Drawing Sheets

(56) References Cited

OTHER PUBLICATIONS

"Drywal 101: What are some different types of Drywall Mud?", no date, [online], retrieved from the Internet, [retrieved Jul. 16, 2015], <URL: http://drywall101.com/articles/types_of_mud.php>.*

Jonni Good, "New Air Dry Clay Recipe, with Better Measurements", 2013, [online], retrieved from the Internet, [retrieved Jul. 15, 2015, <URL: http://www.ultimatepapermache.com/new-air-dry-clay-recipe>.*

* cited by examiner

PAPER-BASED MALLEABLE DOUGH FOR MOULDING AND SCULPTING APPLICATIONS

BACKGROUND

Polystyrene is well known for its use as isolation panel. Because of both its friability and lightness, polystyrene is also used to create decorative objects.

Drawbacks of the use of polystyrene to create objects include its heavy environmental footprint, the fact that it is carcinogenic, its irritability to the skin and eyes, the lack of durability of the resulting object, etc.

The technique of papier mache is also well-known to create decorative and artistic objects. While it does not share the negative environmental characteristics and detrimental health issues of the polystyrene, it is far from being resilient and durable enough to be considered in manufacturing long-lasting artistic, ornamental or functional objects.

Cork is also used to create decorative, artistic and functional objects. A drawback of cork is its increasing scarcity which causes its price to rise. In additional, cork is not malleable, which limits its applications.

There is therefore a need for a material that is ecological, durable, malleable and lightweight.

SUMMARY

Figure 1:
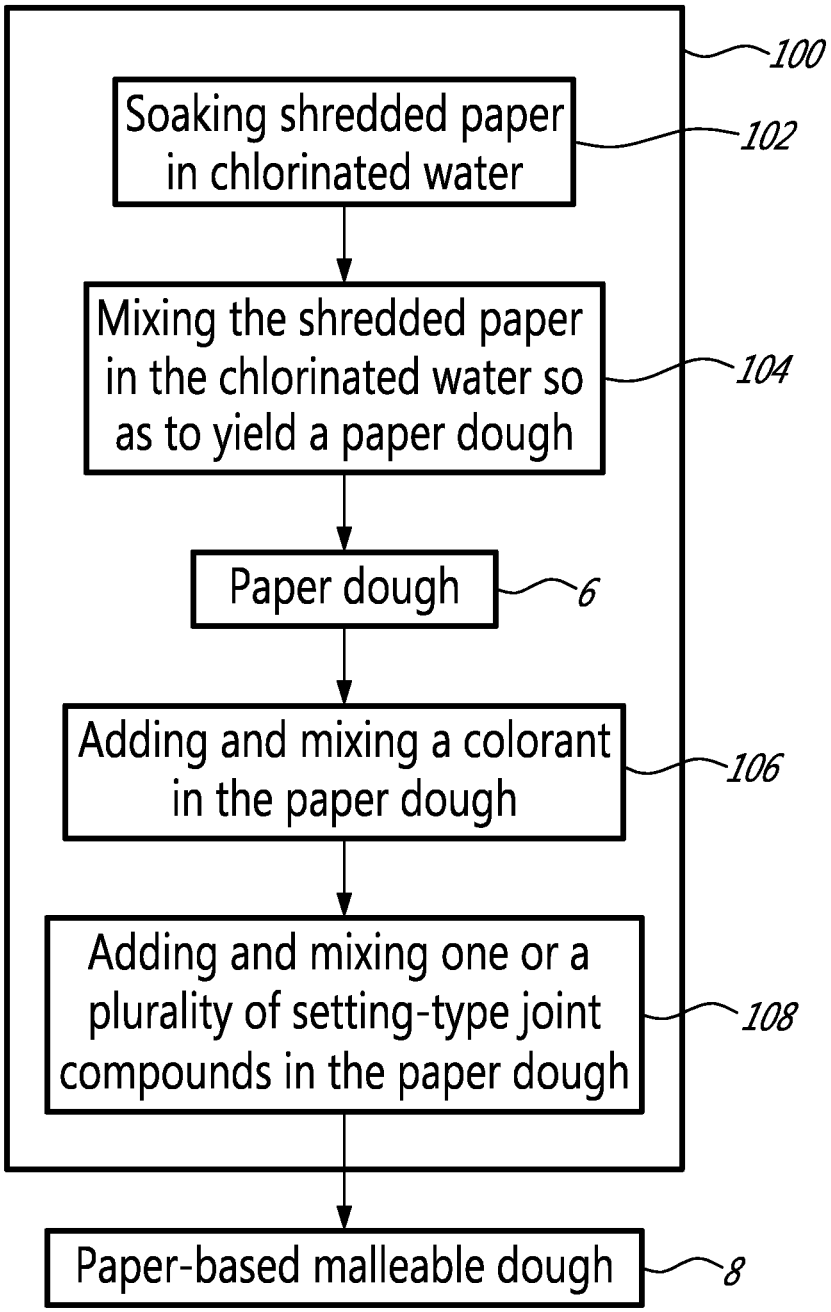
FIG. 1 is a flowchart of a process for manufacturing a paper-based malleable dough according to an illustrative embodiment.

An object of the present invention is to provide a paper-based malleable dough for moulding and sculpting applications that allows creating objects that are ecological, recyclable, durable, malleable and lightweight.

In accordance with an illustrative embodiment, there is provided a paper-based malleable dough comprising:

paper and water, wherein the weight ratio of the shredded paper to the water is between about 1:4 and 1:6 and at least one joint compound in a weight ratio to paper of between about 11:8 to 17:8.

In addition to the above mentioned qualities thereof, the malleable paper-based dough can preserve a given form immediately after its creation, allowing for example successive moulding and unmoulding at a fast pace. Moreover, depending on the intended use, the drying time can be fine tuned within a given range.

According to another illustrative embodiment, there is provided a manufacturing process for a paper-based malleable dough, comprising:

soaking and mixing shredded paper in water, yielding a paper dough; and adding and mixing at least one joint compound with the paper dough, wherein all of the at-least one setting type compound is added in a weight ratio of setting type compound to shredded paper of between about 11:8 to 17:8.

In one embodiment, the least one joint compound is added in a ratio of between about 675 g and 1125 g for one liter of paper dough.

According to still another illustrative embodiment, there is provided a kit for creating an object comprising:

at least one joint compound; and instructions relative to soaking and mixing shredded paper in water for creating a paper dough and for adding and mixing the at least one setting-type joint compound with the paper dough.

According to another embodiment, there is provided a paper-based material including paper and at least one joint compound in a weight ratio to paper of between about 11:8 to 17:8; the material having a density ranging between about 450 kg/m3 and 575 kg/m3.

Other objects, advantages and features will become more apparent upon reading of the following non-restrictive description of illustrative embodiments thereof, given by way of example only with reference to the accompanying drawings.

DETAILED DESCRIPTION

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

The expression "paper" is to be construed in the description and in the claims as including any sheet-like material manufactured with vegetable fibers pulped, including paper and cardboard which are new or recycled, newspaper, etc.

A process 100 for manufacturing a paper-based malleable dough 8 will now be described with reference to FIG. 1.

The process 100 includes:

102—soaking shredded paper in the chlorinated water;

104—mixing the shredded paper in the chlorinated water so as to yield a paper dough 6;

106—adding and mixing a colorant in the paper dough 6; and

108—adding and mixing one or a plurality of setting-type joint compound in the paper dough 6.

Each of the steps 102 to 108 will now be described in more detail.

In step 102, shredded paper is first mixed in chlorinated water.

The shredded paper can be provided in a wide size range of its individual pieces. For example, the shredded paper is in the form of 5 mm by 3 cm paper bands such as provided by a typical paper shredding machine.

Prior of or after the shredded paper is added in the water, a chlorination tablet is added and mixed in the water. Chlorine is added in the water to act as an antifungal agent. In addition to contribute to the long lasting of the final product, the chlorine also acts as a bleaching agent on the paper. This allows yielding a white paper or at least a lighter dough at the end of step 102.

The chlorine is added in water according to a ratio of 1 g per 10 liters of water. For example, a typical chlorine tablet used in the maintenance of a pool or spa can be used. According to another embodiment, the chlorine is added in another form than tablet, such as in liquid or powder form.

Also, the chlorine can be added in the water according to another ratio, wherein a more dilute solution of chlorine may result in a darker-tone and/or a less clean dough following step 102.

According to still another embodiment, the chlorine is omitted or substituted or complemented by other bleaching and/or antifungal agent.

According to the first illustrated embodiment, the shredded paper is added in the chlorinated water according to a weight ratio of the shredded paper to the water of about 1:5.

As will become more apparent upon reading the remaining description of the process 100, the quantity of water may vary from the above-mentioned shredded paper to water ratio. Such a ratio will impact on the consistency of the final product at the end of step 108 and its drying time.

The shredded paper is soaked in the chlorinated water for a period of time within about 2 minutes and 24 hours.

After the above soaking time, a paper dough 6 is created by further mixing the shredded paper/chlorinated mixture. This can be achieved using for example a mixer that includes sharpened blade, but any mixing device, implement or method can be used in step 102.

A colorant is then added and mixed to the paper dough (step 106). Any mixing device, implement or method can be used to achieve a homogenous mixture. The resulting mix then rests for about two (2) hours.

According to the first illustrated embodiment, an ecological latex-based colorant is added in sufficient quantity to achieve a desired aesthetic result. According to another embodiment, another colorant type is used. According to still another embodiment, step 106 is omitted.

Since it is believed to be within the reach of a person skilled in the art to add colors to a paper-based product, it will not be described herein in more detail for concision purposes.

In step 108, three different joint compounds are added and mixed in the paper dough 6.

Two of the three compounds added in step 108 are chemically setting compounds for gypsum panels and ceiling boards such as the asbestos-free Durabond® 45 and Durabond® 90 setting-type joint compounds from CGC Inc. According to the manufacturer, the Durabond® 45 has a setting time of between 30-80 minutes, while the Durabond® 90 has a setting time of between 85-130 minutes. Each compound is added to the paper dough 6 in a weight ratio of compound to shredded paper of about 1:2. For example, for a paper dough formed by mixing about 1.8 kg (4 lbs) of shredded paper to about 9.1 kg (20 lbs) of water in step 102, 0.9 kg (2 lbs) of each setting-type joint compound is added, which corresponds to about 1 liter of each compound. Both compounds are homogeneously mixed with the dough 6.

It has been found that adding joint compound to the paper dough resulting from step 104 or 106 yields a malleable paper pulp which can be shaped and formed, for example by moulding or sculpture, and which holds a given shape.

The third compound that is added in step 106 is a SHEETROCK® ceiling spray texture powder such as produced by CGC Inc. According to the first illustrated embodiment, the sheetrock ceiling spray texture powder is the CGC SHEETROCK® Brand Ceiling Spray Texture E-Z Spray. This third compound is added to the paper dough in a weight ratio of compound to shredded paper of about 3:4. For the aforementioned exemplary quantity, about 1.4 kg (3 lbs) is added. This corresponds to about 2 liters of powder.

This third compound adds texture to the finished product 8 after the malleable dough is given sufficient time to dry. The resulting product has a look similar to rock or concrete.

All three compounds added in step 108 are in powder form and the total amount thereof is between 2.5 kg and 3.9 kg for each 1.8 kg of shredded paper. In other words, the total amount of compound added in step 108 is in a weight ratio of compound to shredded paper of between about 11:8 to 17:8.

Adding more joint compound powder in step 108 for a given weight of paper dough results in a malleable paper dough 8 which takes less time to dry, but, as a tradeoff, that is more dense and heavy. Conversely, adding less joint compound in step 108 results in a malleable paper dough 8 that takes longer to dry but that is lighter. The quantity of compounds added in step 108 can also be adapted to the quantity of water used in step 102. For example, using a lesser quantity of water in step 102 for a given weight of shredded paper may be compensated by using a lesser amount of joint compounds in step 106.

Also, the quantity of SHEETROCK® ceiling spray texture powder may be compensated by adding more of the two chemically setting compounds. According to another embodiment, the SHEETROCK® ceiling spray texture powder is omitted.

According to another embodiment, other joint compound than those mentioned hereinabove are used in manufacturing a paper-based malleable dough 8 which can keep a given shape immediately after step 108. The brands and manufactures of joint compounds are only given for illustrative purposes.

The malleable paper dough 8 resulting from step 108 is ready to be formed and/or used in manufacturing products.

It is important to note that implementing the process 100 using the fixed quantities and ratio values provided hereinabove yields a paper-based malleable dough 8 than can maintain a given form and therefore which can be unmoulded immediately after moulding.

Figure 2:
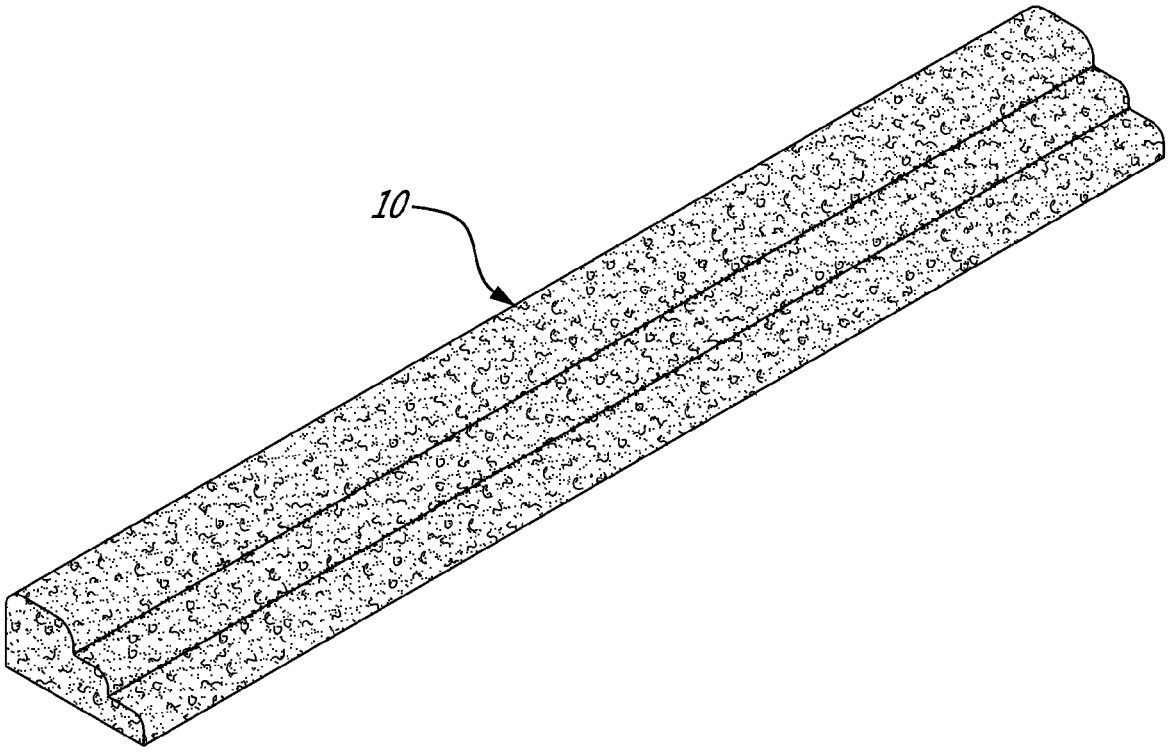
FIG. 2 is a perspective view of an ornamental moulding manufactured using the paper-based malleable dough resulting from the process from FIG. 1.

FIG. 2 shows an example of an ornamental moulding 10 formed using the paper-based malleable dough 8.

Figure 3:
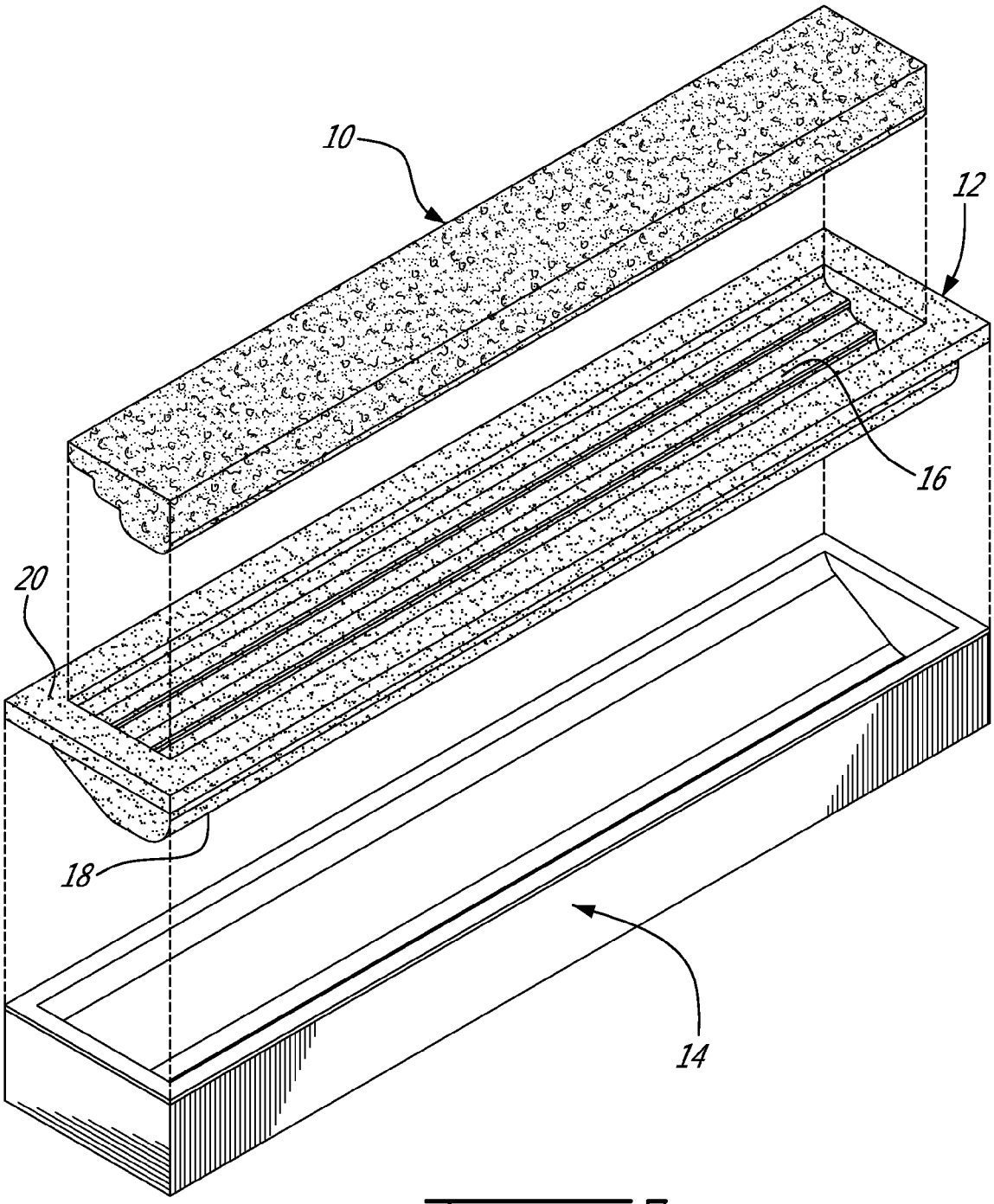
FIG. 3 is a perspective view of the moulding from FIG. 2, illustrated with a soft mould cavity and a mould support used in its shaping.

With reference to FIG. 3, the moulding 10 is obtained by filling a soft mould cavity 12 with the paper-based malleable dough 8. The mould cavity 12 is made of a latex mould making rubber, such as the one sold by Smooth-On corporation. A rigid support cavity 14 is provided to receive the soft mould cavity 12 when the dough 8 is casted therein.

The soft mould cavity 12 has a first concave side 16 that is complementary shaped to yield the ornamental moulding 10 and a second convex opposite side 18 that generally complements the rigid support cavity 14.

In operation, while the soft mould cavity 12 is received within the rigid support cavity 14, the paper-based malleable dough 8 is filled therein and a spatula, a scrapper or any other leveling tool is used to evenly distribute and compact the dough 8 in the soft mould cavity 12. Any excessive amount of dough 8 is also removed by leveling the dough 8 with the flange 20 and by removing any dough 8 onto the flange 20.

Even though the dough 8 remains malleable as soon as the process 100 is completed, it is sufficiently consistent to keep a given form. This allows the ornamental mould 10 to be unmoulded at any time. A manual or automatic process can then be provided wherein a single mould cavity 12 is repeatedly filled and emptied in sequentially creating a plurality of moulds 10.

The use of a soft mould cavity 12 has been found to ease the unmoulding step.

It is to be noted that the quantity of dough 8 required to create a given form by moulding or else can be pre-determined considering the volume of the resulting moulded piece.

After the paper-based malleable dough 8 has been shaped, such as for example after moulding, the resulting object 10 is set aside for drying for about twenty four (24) to thirty six (36) hours.

According to the first illustrated embodiment, the object 10 is dried by laying it on a grid (not show) in a drying chamber at a temperature of about twenty seven degrees Celsius (27° C.). To improve the drying time, the drying chamber includes conventional humidity control and ventilation.

According to another embodiment, the object 10 is unmoulded onto a plate (not shown) and remains thereon for about twenty four (24) to thirty six (36) hours. After that first drying period, the object 10 is laid on a grid (not shown) until it is sufficiently dried for its intended purposes.

It is to be noted that the drying time varies with the geometry and dimension of the object and according to the environmental condition surrounding the object 10. It is believed to be within the reach of a person skilled in the art to evaluating the drying time and estimate when the object is dried.

According to some embodiment, a finishing step is provided after drying. According to this step, any imperfection of the object 10 is removed and the contour of the object 10 is sanded.

The resulting product 10 can be painted as needed using for example a latex-based paint.

To extend the life of the object 10, it is then sealed prior to be exhibited, used or installed in accordance with its function. This sealing step aims at improving the solidity of the object 10 and to protect it against humidity, water, common cleaning products and more generally any domestic liquid products, including most drinks.

The sealer used is for example a common wood varnish such as the Satin water based varnish produced by SamaN™. Other water-based or oil-based wood varnishes can also be used and so is another sealer suitable for wood or paper. According to another embodiment, a sealing paint is used to seal and color the object 10.

According to some embodiment, the sealing step is omitted, for example in the case of a disposable object.

Generally stated, an object manufactured using a paper-based malleable dough 8 resulting has the following structural characteristics:

- it is relatively lightweight, having a density ranging between about 450 kg/m$^3$ and 575 kg/m$^3$, depending on the amount and type of joint compound in its composition. In comparison, Styrofoam as a density of about 300 kg/m$^3$;
- once sealed, it is impermeable and durable;
- it is hard enough to resist a normal impact, but is also resilient enough so as not to be abrasive or cutting;
- when it is made from a dough that has been colored, its appearance is uniformed throughout its volume. This allows the object to keep its finished look when it is chipped;
- because the dough 8 is malleable for a sufficiently long time, it is possible to incorporate other materials or objects on or in the dough, including stones, implements, sticks, straws, etc. These incorporations will be locked in place, once the dough 8 is dry;
- the default aspect of the object, i.e. its appearance without adding any color thereon or other treatment is very similar to concrete. This renders the paper-based malleable dough 8 suitable to easily create imitation pieces of concrete or rock.

Figure 4:
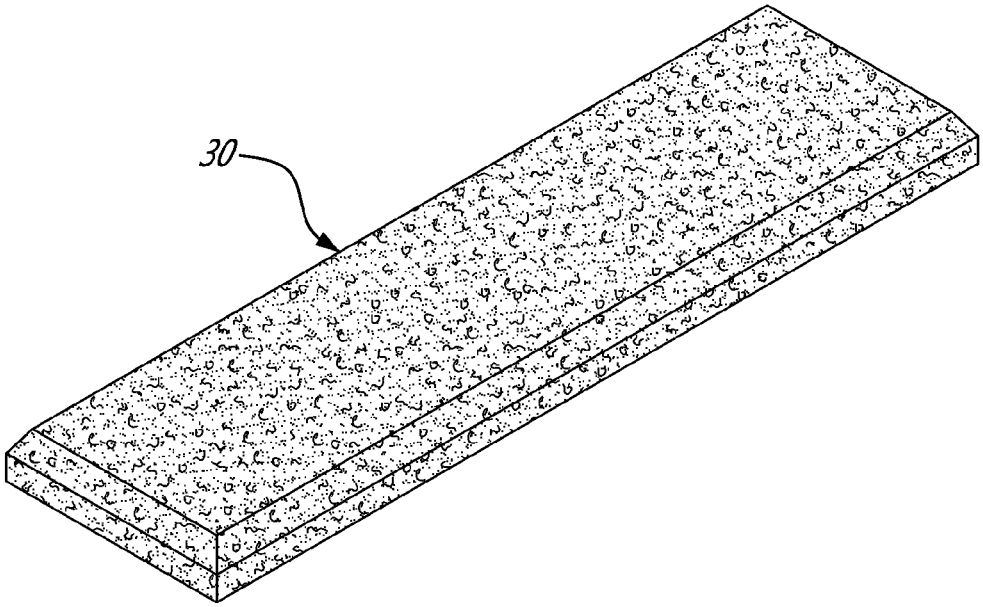
FIG. 4 is a perspective view of an ornamental shelf manufactured using the paper-based malleable dough resulting from the process from FIG. 1.
Figure 5:
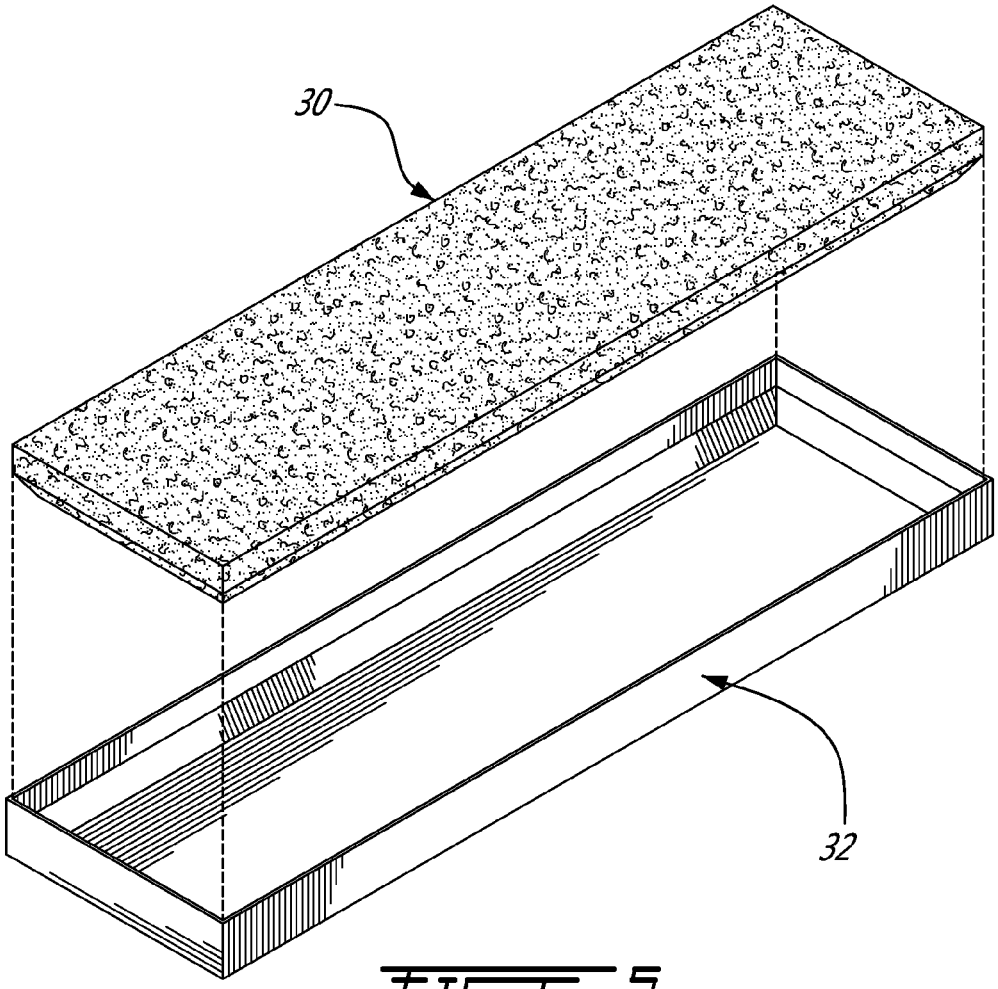
FIG. 5 is a perspective view of the shelf from FIG. 4, illustrated with a rigid cavity used in its shaping.

FIG. 4 illustrates a wall brick 30 created using a process similar to the one described above with reference to the ornamental moulding piece 10. The difference resides in the mould cavity 32 used in the moulding process, which is rigid. The cavity 32, which is illustrated in FIG. 5, can be made of steel or of any other rigid material that can withstand humidity.

Figure 6:
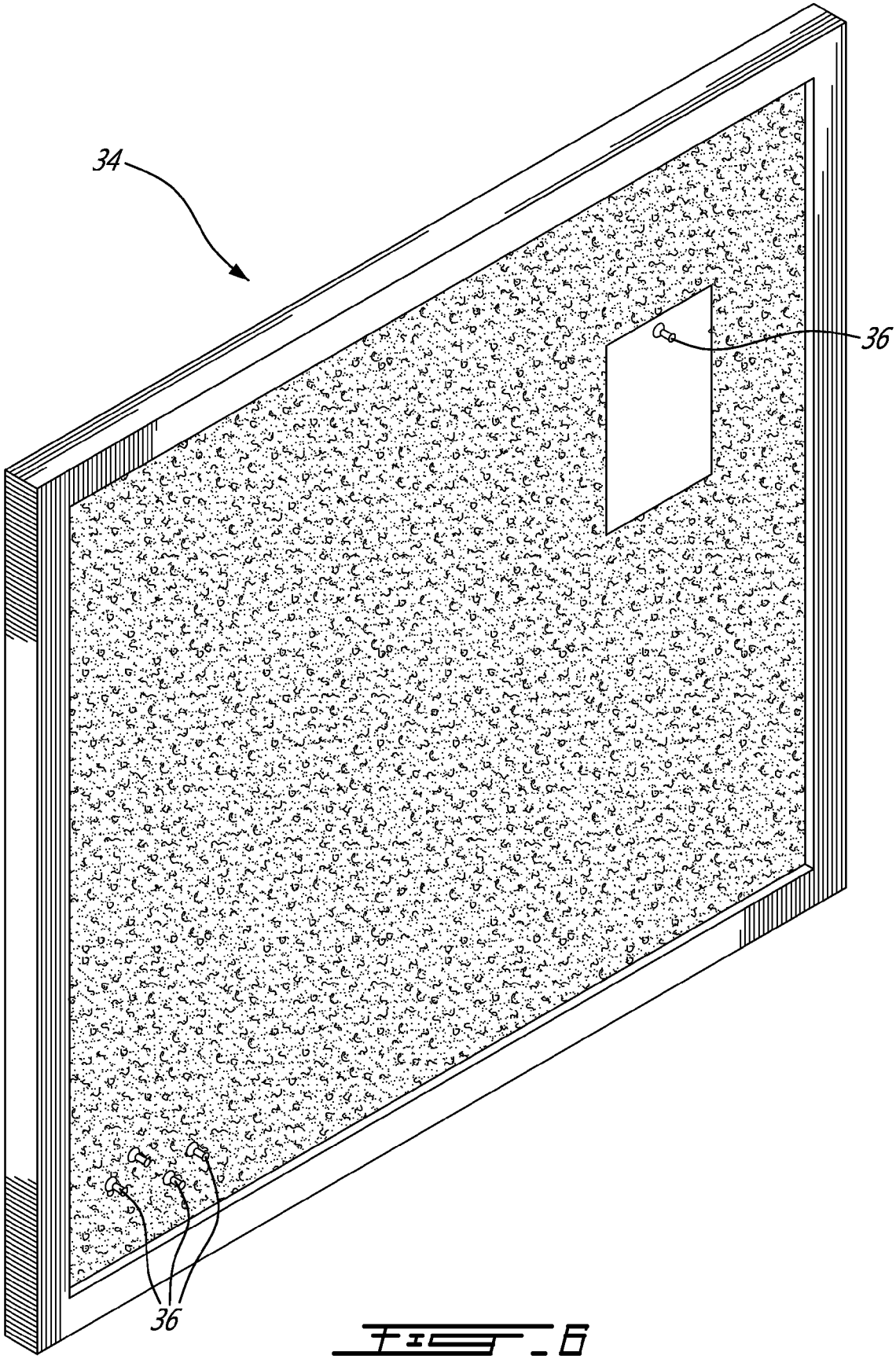
FIG. 6 is a display board incorporating a panel manufactured using the paper-based malleable dough resulting from the process from FIG. 1.

As mentioned hereinabove, an object made from the dough 8 is resilient, even after it is dried. Without being necessarily identical, its resilience and plasticity are similar to Styrofoam and cork. This makes the material suitable to be formed as a panel to be used as a bulletin board. FIG. 6 shows a framed embodiment of such a bulletin board 34. Indeed, the resiliency of the bulletin board 34 allows repeatedly receiving pins 36.

Figure 7:
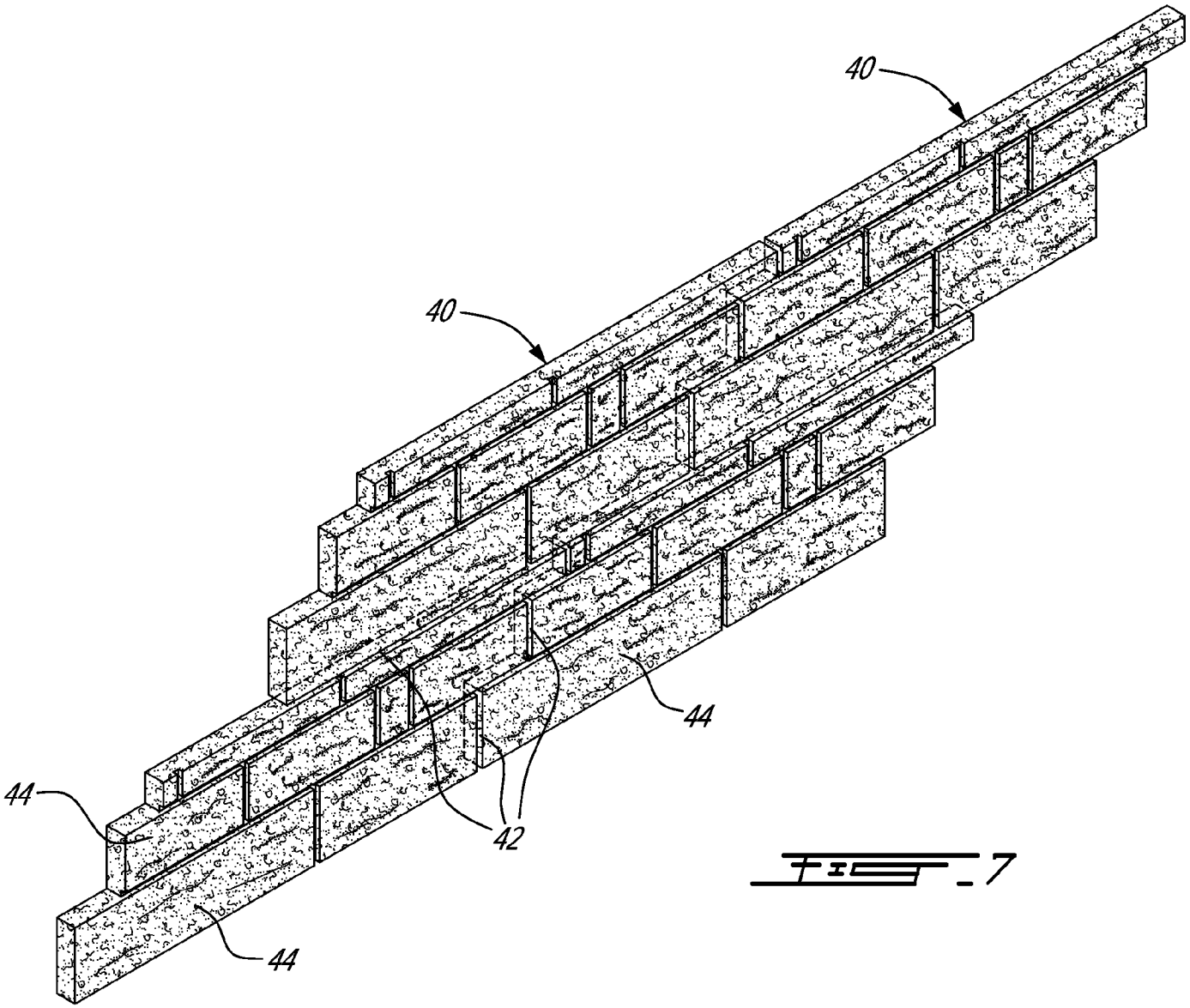
FIG. 7 is a perspective view of a wall section made using faux brick wall panels manufactured using the paper-based malleable dough resulting from the process from FIG. 1.

FIG. 7 shows two identical faux brick wall panels 40 moulded with the dough 8. Wood ashes (not shown) are sprinkled onto the the paper-based dough 8 before it is imprinted with the mould. The ashes bind to the corresponding surface of the object 40 to better the stone-like finish. More specifically, it has been found economically efficient to use wood pellets ashes resulting from a wood pellet stove that is used, for example, as the heat source in the drying chamber (not shown).

Each panel 40 has one lateral side that complements the opposite side thereof to ease the assembly of a plurality of panels 40 into a faux brick wall (not shown). The gap 42 between adjacent panels 40 can be filled with mortar joints (not shown) or silicone grout to better the illusion of a conventional brick stone wall in complementing the faux-joint between adjacent bricks 44.

Compared with a conventional brick stone wall, a wall made from the panels 40 is much lighter and easier to wash. It is also easier to install and repair. Indeed, the panels are sufficiently light to be glued on a flat wall and/or secured using finishing nails (not shown). The dough 8, once dry, having the above-mentioned plasticity, it is possible to hide the finishing nails by manual touchups, even though such touchups are usually rendered unnecessary by the inherent plasticity of the material.

Figure 8:
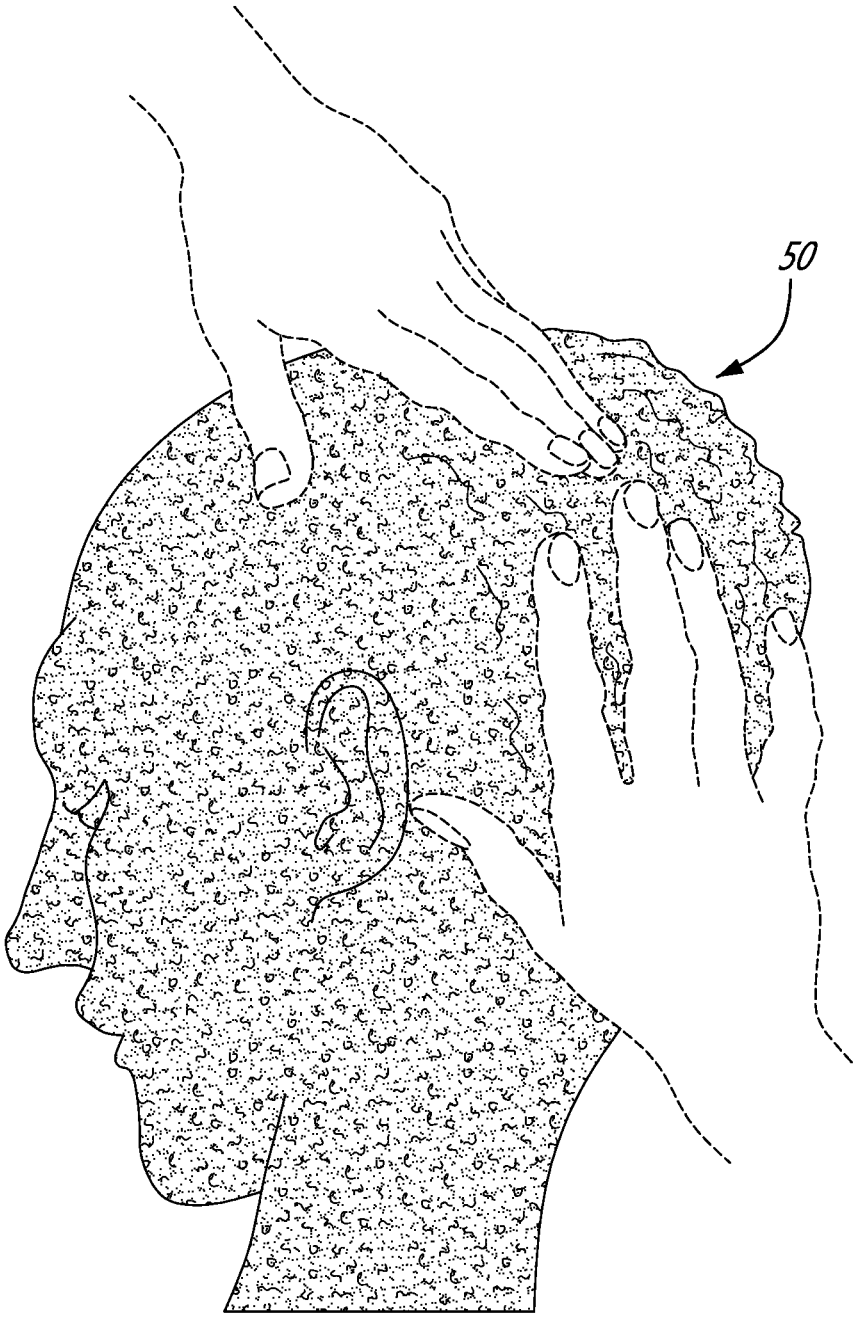
FIG. 8 is perspective view illustrating the sculpting of a head using the paper-based malleable dough resulting from the process from FIG. 1.

As mentioned hereinabove, the dough 8 is not limited to be shaped by moulding. As illustrated in FIG. 8, the dough 8 can be sculpted in an infinity of forms, such as the head 50. Also, as mentioned hereinabove, the dough 8 remains deformable for a few hours which allows adding decorative or structural elements thereon or therein.

According to another embodiment, a kit (not shown) is provided that includes all or some of the ingredients allowing to create a small batch of dough 8 with instructions therefore. Such a kit is intended for both children and adults and would empower them to create a sculpture of their own design and/or would include one or a plurality of small mould cavities allowing to create one or more object or parts thereof. A painting set or colorant can also be included in such a kit.

It is to be noted that many modifications could be made to the process for manufacturing a paper-based malleable dough described hereinabove and illustrated in the appended drawings and to an object made from such a dough.

For example, even if the joint compounds used in the process for manufacturing a paper-based malleable dough described hereinabove are silica-based, other types of such compounds can also be used.

Even though the above-mentioned moulding process of the paper-based malleable dough have been described as being of the compression type, injection moulding can also be used to shape the dough.

Although the present invention has been described hereinabove by way of illustrated embodiments thereof, it can be modified, without departing from the spirit and nature of the subject invention as defined in the appended claims.

The invention claimed is:

1. A paper-based malleable dough manufacturing process, comprising:

providing a paper dough comprising paper and water; and adding and mixing at least one setting-type joint compound with the paper dough, wherein the at least one setting-type joint compound is added in a dry weight ratio of setting-type joint compound to paper of between about 11:8 to 17:8.

2. A process according to claim 1, further comprising adding and mixing a colorant into the paper dough.

3. A process according to claim 1, wherein the at least one setting-type joint compound comprises two (2) different types of setting-type joint compounds, each type having a different setting time.

4. A process according to claim 3, wherein the at least one setting-type joint compound further includes a textural setting-type joint compound.

5. A process according to claim 1, wherein the at least one setting-type joint compound includes a textural setting-type joint compound.

6. A process according to claim 1, wherein the paper dough comprises a weight ratio of paper to water of about 1:5.

7. A process according to claim 1, wherein the water includes at least one of an antifungal agent and a bleaching agent.

8. A process for manufacturing a product comprising:

providing a paper dough comprising paper and water;

adding and mixing at least one setting-type joint compound with the paper dough, yielding a malleable dough; wherein the at least one setting-type joint compound is added in a ratio of between about 675 g and 1125 g for one litre of paper dough;

shaping the malleable dough in the shape of the product; and drying the product.

9. A process as recited in claim 8, wherein shaping the malleable dough includes moulding the malleable dough.

10. A process as recited in claim 9, wherein moulding the malleable dough includes using a soft mould cavity received in a rigid support cavity.

11. A process as recited in claim 9, wherein moulding the malleable dough includes unmoulding the product before the product is dried.

12. A process as recited in claim 9, wherein shaping the malleable dough further includes adding ashes thereon.

13. A process as recited in claim 8, further comprising sealing the product after drying the product.

14. A process as recited in claim 8, further comprising removing imperfections from the product after drying the product.

15. A process as recited in claim 8, wherein the product is selected from the group consisting of a bulletin board panel, a faux brick wall panel, an ornamental moulding, a faux stone panel and a sculpture.

16. A method for manufacturing a paper-based product, comprising:

providing a paper dough comprising paper and water;

mixing the paper dough with at least one setting-type joint compound to obtain a mixture comprising a dry weight ratio of setting-type joint compound to paper of between about 11:8 to 17:8;

moulding said mixture to obtain a moulded product of a desired shape; and allowing the moulded product to dry.

17. The method of claim 16, wherein the paper-based product is selected from the group consisting of a bulletin board panel, an isolation panel, a faux brick wall panel, an ornamental moulding, and a faux stone panel.

18. The method of claim 16, wherein the at least one setting-type joint compound is a setting-type compound for gypsum panels and ceiling boards.

19. A method for manufacturing a paper-based product, comprising:

providing a paper dough comprising paper and water;

mixing the paper dough with at least one setting-type joint compound to obtain a mixture comprising between about 675 g and 1125 g of setting-type joint compound for one liter of paper dough;

moulding said mixture to obtain a moulded product of a desired shape; and allowing the moulded product to dry.

20. The method of claim 19, wherein the paper-based product is selected from the group consisting of a bulletin board panel, an isolation panel, a faux brick wall panel, an ornamental moulding, and a faux stone panel.

21. The method of claim 19, wherein the at least one setting-type joint compound is a setting-type compound for gypsum panels and ceiling boards.

* * * * *